US009170022B2

(12) United States Patent
Grimm et al.

(10) Patent No.: US 9,170,022 B2
(45) Date of Patent: Oct. 27, 2015

(54) PREMIX BURNER FOR A GAS TURBINE

(75) Inventors: Frank Grimm, Baden (CH); Fulvio Magni, Nussbaumen (CH); Weiqun Geng, Dättwil (CH); Douglas Anthony Pennell, Windisch (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 1052 days.

(21) Appl. No.: 13/218,065

(22) Filed: Aug. 25, 2011

(65) Prior Publication Data

US 2012/0047898 A1 Mar. 1, 2012

(30) Foreign Application Priority Data

Aug. 27, 2010 (CH) ..... 01389/10

(51) Int. Cl.
*F23R 3/12* (2006.01)
*F23R 3/28* (2006.01)

(52) U.S. Cl.
CPC . *F23R 3/12* (2013.01); *F23R 3/286* (2013.01); *F23C 2900/07002* (2013.01); *F23D 2900/14021* (2013.01); *Y10T 29/4932* (2015.01); *Y10T 29/49716* (2015.01)

(58) Field of Classification Search
CPC .. F23R 3/12; F23R 3/286; F23C 2900/07002; F23D 2900/14021
USPC ..... 60/734–739; 239/403; 431/352
See application file for complete search history.

(56) References Cited

U.S. PATENT DOCUMENTS

| | | | | |
|---|---|---|---|---|
| 4,932,861 | A * | 6/1990 | Keller et al. | 431/354 |
| 5,738,509 | A * | 4/1998 | Marling et al. | 431/352 |
| 5,921,770 | A | 7/1999 | Sattelmayer | |
| 6,132,202 | A * | 10/2000 | Eroglu et al. | 431/350 |
| 6,270,338 | B1 * | 8/2001 | Eroglu et al. | 60/737 |
| 7,013,648 | B2 * | 3/2006 | Griffin et al. | 60/737 |
| 7,140,183 | B2 * | 11/2006 | Ruck et al. | 60/737 |
| 7,520,745 | B2 * | 4/2009 | Oomens et al. | 431/354 |
| 8,801,429 | B2 * | 8/2014 | Eroglu et al. | 60/737 |
| 2003/0152880 | A1 | 8/2003 | Eroglu et al. | |
| 2005/0115244 | A1 | 6/2005 | Griffin et al. | |
| 2007/0207431 | A1 * | 9/2007 | Oomens et al. | 431/354 |

FOREIGN PATENT DOCUMENTS

| | | | |
|---|---|---|---|
| DE | 10029607 | A1 | 12/2001 |
| EP | 0851172 | A2 | 7/1998 |
| WO | 03098110 | A1 | 11/2003 |

OTHER PUBLICATIONS

Office Action (Patent Examination Report No. 1) issued on Aug. 19, 2013, by the Australian Patent Office in corresponding Australian Patent Application No. 2011213841. (3 pages).

* cited by examiner

*Primary Examiner* — J. Gregory Pickett
(74) *Attorney, Agent, or Firm* — Buchanan Ingersoll & Rooney PC

(57) ABSTRACT

A premix burner is provided for a gas turbine, in the form of a double-cone burner, which has two partial cone shells which are arranged nested one inside the other, forming air inlet ducts between them, through which combustion air from the outside flows into a conical inner space of the premix burner. Linear rows of holes of injection openings, which extend transversely to the flow direction of the combustion air, are arranged on the outer walls of the air inlet ducts and through which a gaseous fuel is injected into the combustion air which flows past transversely to them. A method for reworking such premix burners is also provided.

10 Claims, 2 Drawing Sheets

PREMIX BURNER FOR A GAS TURBINE

FIELD OF INVENTION

The present invention relates to the field of gas turbine technology. It refers to a premix burner for a gas turbine and also refers to a method for reworking such premix burners.

BACKGROUND

The present invention starts from a premix burner for a gas turbine in the form of a so-called "double-cone burner", as is known, for example, from U.S. Pat. No. 5,921,770, which is incorporated by reference. The first figure of this application is generally reproduced here as FIG. 1.

The premix burner 10 according to FIG. 1 is comprised of two hollow partial cone shells 11, 12 which extend along an axis (29 in FIG. 2) and are nested one inside the other in an offset manner in relation to each other. The offset of the respective center axis or longitudinal symmetry axis of the partial cone shells 11, 12 in relation to each other creates, on both sides, in a mirror-image arrangement, a tangential air inlet duct 18, 19 in each case through which combustion air 20 flows into the conical inner space 30 of the burner. The two partial cone shells 11, 12 have in each case an entry section in the form of a cylinder 14, 15. Accommodated in the region of the cylinders 14, 15 is a nozzle 24 for atomizing a preferably liquid fuel 23 which, after combustion together with the injected combustion air 20, forms a flame front 28.

Naturally, the premix burner 10 can be of purely conical design, that is to say without the cylinders 14, 15. The partial cone shells 11, 12 furthermore have in each case a fuel line 16, 17 which are arranged along the tangential air inlet ducts 18, 19 and provided with injection openings 21 in the form of linear rows of holes through which a gaseous fuel 22 is injected into the combustion air 20 which flows past there, as is represented by means of arrows. These fuel lines 16, 17 are preferably placed at the latest at the end of the tangential inflow before entry into the inner space 30 in order to ensure optimum air/fuel mixing.

Towards the combustion chamber 25, the premix burner 10 has a front plate 13, serving as an anchor for the partial cone shells 11, 12, with a number of holes 26 through which cooling air 27 can be fed to the front section of the combustion chamber 25 as required.

The design and arrangement of the injection openings 21 for the gaseous fuel 22 has considerable influence upon the mixing of the fuel with the combustion air 20. The fuel 22 is injected into the air inlet passage 18, 19 of the premix burner 10 perpendicularly to the air flow. Mixing of the fuel 22 with the air is influenced both by the location of the injection openings 21 and by the flow velocity of the gaseous fuel.

In premix burners of the described type in use up to now, use is made of injection openings 21 which are represented as a row of holes R1 in FIG. 2, wherein such a row of holes is associated in each case with each of the two air inlet ducts 18, 19. If natural gas is used as the gaseous fuel, 32 injection openings 21 with a small outside diameter are arranged in the row of holes R1.

It has now transpired that during operation of such premix burners the mixing-through of the combustion air and the gaseous fuel can be improved more in order to lower the peak values of the flame temperature in the burner and therefore to reduce pollutant emissions (for example NOx).

SUMMARY

The present disclosure is directed to a premix burner for a gas turbine, in the form of a double-cone burner, having two partial cone shells arranged nested one inside the other, forming air inlet ducts between them, through which outside combustion air flows into a conical inner space of the premix burner. Linear rows of holes of injection openings, which extend transversely to a flow direction of the combustion air, are arranged on the outer walls of the air inlet ducts and through which a gaseous fuel is injected into the combustion air which flows past transversely to them. The injection openings have a diameter ratio of a diameter of the injection opening to an effective outlet diameter of the premix burner between 0.011 and 0.015.

In another aspect, the present disclosure is directed to a premix burner for a gas turbine, in the form of a double-cone burner, having two partial cone shells arranged nested one inside the other, forming air inlet ducts between them, through which outside combustion air flows into a conical inner space of the premix burner. Linear rows of holes of injection openings, which extend transversely to a flow direction of the combustion air, are arranged on the outer walls of the air inlet ducts and through which a gaseous fuel is injected into the combustion air which flows past transversely to them, the injection openings have a diameter ratio of a diameter of the injection opening to an effective outlet diameter of the premix burner which is greater than 0.015 and less than 0.017.

In a further aspect, the present disclosure is directed to a method for reworking premix burners for a gas turbine, in the form of a double-cone burner, having two partial cone shells arranged nested one inside the other, forming air inlet ducts between them, through which outside combustion air flows into a conical inner space of the premix burner. Linear rows of holes of injection openings, which extend transversely to the flow direction of the combustion air, are arranged on the outer walls of the air inlet ducts and through which a gaseous fuel is injected into the combustion air which flows past transversely to them. The method includes closing every other hole of a row of holes of injection openings and enlarging the diameter of remaining injection openings.

BRIEF DESCRIPTION OF THE DRAWINGS

The invention shall subsequently be explained in more detail based on exemplary embodiments in conjunction with the drawings. In the drawings.

DETAILED DESCRIPTION OF THE PREFERRED EMBODIMENTS

Introduction to the Embodiments

Figure 1:
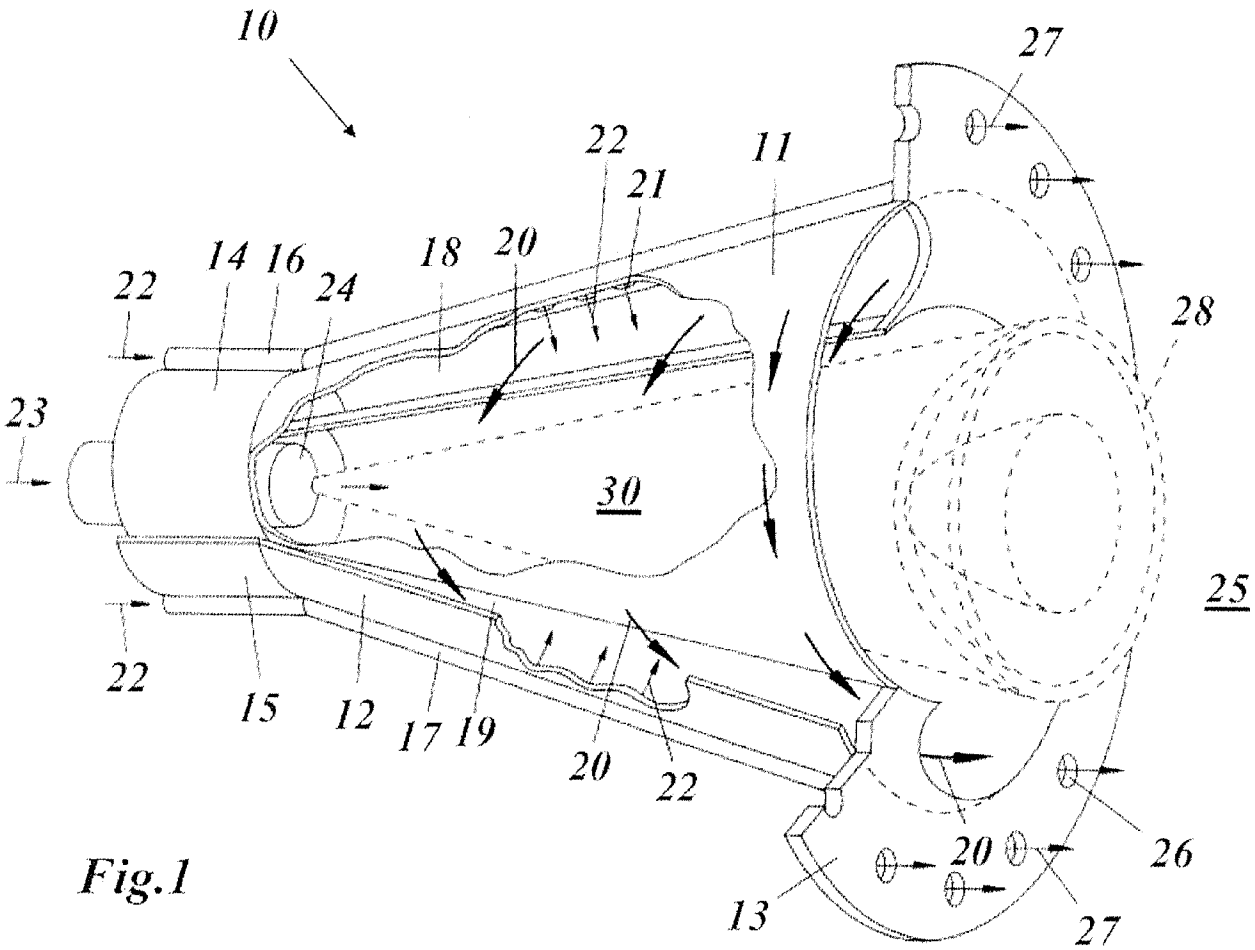
FIG. 1 shows in a perspective, partially sectioned side view a known premix burner of the double-cone type, as is suitable for realization of the invention.

It is therefore the object of the invention to create a premix burner of the type referred to in the introduction, which is significantly improved with regard to the intermixing of combustion air and gaseous fuel.

The object is achieved by means of the entirety of the features of claim 1. It is preferable for the solution according to the invention that the injection openings are enlarged in their diameter. This enlargement, however, must be limited to a specific range. Furthermore, it was discovered that the absolute size of the diameter is not critical for achieving good results but a diameter ratio of diameter of the injection opening 21 to effective outlet diameter of the premix burner 10 in each case is. In this case, the diameter of a circle which has the same area as the outlet opening of the premix burner is to be understood as an effective outlet diameter of the premix burner.

A typical conventional hole diameter of a burner for natural gas with high methane content led to a diameter ratio of 0.0086 for example when using the newly introduced ratio of diameter of the injection opening 21 to effective outlet diameter of the premix burner 10. For a gaseous fuel with a lower calorific value, a diameter ratio of diameter of the injection opening 21 to effective outlet diameter of the premix burner 10 of 0.0097 was used, for example.

For the best intermixing and combustion, a range of diameter ratios of diameter of the injection opening to effective outlet diameter of the premix burner, which lies between 0.011 and 0.015, has newly been determined. For operation with a gaseous fuel with a calorific value which lies at least 20% below the calorific value of methane, a widened range of diameter ratios of diameter of the injection opening to effective outlet diameter of the premix burner is proposed which is greater than 0.015 and less than 0.017. Overall, this results in an advantageous range of diameter ratios of 0.011 to 0.017. Correspondingly, the distance between the injection openings is also increased or the overall number of injection openings is reduced.

The injection openings were conventionally kept as small as possible in order to enable a good intermixing. A minimum size, however, was necessary in order to minimize the pressure losses which arise during injection of the fuel.

As a result of the new design of the rows of holes with larger diameter, a higher impulse of gas jets coming from the injection openings ensues, leading to an increased penetration of the transversely-flowing combustion air and therefore to improved mixing. With the improved mixing, the flame temperatures even out, which is accompanied by a reduction of temperature peaks and of pollutant emissions which are caused by them.

In a further aspect of the disclosure, it is sought to specify a height of the air inlet ducts, into which the combustion gas 2 is introduced into the premix burner, in a range which is adapted to the injection opening and which leads to good mixing-through with low pressure loss and stable combustion. In combination with the stated ratios of the diameter of the injection opening to effective outlet diameter of the premix burner, in each case a ratio of diameter of the injection opening to height of the air inlet duct which lies between 0.097 and 0.153 is advantageous.

In a further development of the invention, in each case a ratio of the sum of the areas of the injection openings to effective outlet diameter of the premix burner should be selected in an advantageous range. For the proposed hole diameter ranges, said range lies between 0.0051 and 0.0097.

According to one development of the invention, all the injection openings of a row of holes have the same diameter and are equidistant.

In another development of the invention, the distance between adjacent injection openings of a row of holes is approximately 16 mm.

For operation with natural gas, it is possible furthermore to specify an advantageous range of the ratio of diameter of the injection opening to height of the air inlet ducts which lies between 0.109 and 0.124. In combination with the specified hole diameter ranges, in particular, two particularly advantageous partial ranges of the ratio of diameter of the injection opening to height of the air inlet ducts have been determined. These are the ranges of 0.109 to 0.112 and 0.119 to 0.124.

In another development of the invention, the premix burner is intended for operation with natural gas as the gaseous fuel, and the ratio of hole diameter of the injection openings to the effective outlet diameter of the premix burner is 0.012 in each case.

In a further development of the invention, the premix burner is intended for operation with a gaseous fuel which has a calorific value which lies at least 20% below the calorific value of methane, and the injection openings have in each case a diameter ratio of diameter of the injection opening to effective outlet diameter of the premix burner of 0.0137.

For operation with a gaseous fuel with a calorific value which lies at least 20% below the calorific value of methane, it is possible furthermore to specify an advantageous range of the ratio of diameter of the injection opening to height of the air inlet ducts which lies between 0.123 and 0.140. In combination with the specified hole diameter range, in particular, two particularly advantageous partial ranges of the ratio of diameter of the injection opening to height of the air inlet ducts have been discovered. These are the ranges of 0.123 to 0.128 and 0.134 to 0.140.

The combustion gas speed into the injection openings must, on the one hand, be high enough to attain good mixing-through, but on the other hand should be low in order to keep pressure losses in the combustion gas system low and thereby eliminate, or minimize, a compression of the combustion gas, which may be required depending on the pressure level of the gas supply system, before the introduction. Here, the combustion gas speed into the injection openings is proportional to the gas quantity and inversely proportional to the sum of the areas of the injection openings of a burner. Typically, the combustion gas quantity introduced into a burner is also proportional to the burner size. The ratio of the sum of the areas of the injection openings of a burner to the effective outlet area of the premix burner is projected as a characteristic variable for an optimum burner selection, wherein the effective outlet diameter corresponding to the effective outlet area is typically used as a measure for the burner size. For operation with natural gas, a ratio which lies between 0.005 and 0.008 was found to be an advantageous ratio of the sum of the areas of the injection openings to effective outlet area of the premix burner. For operation with a gaseous fuel with a calorific value at least 20% below the calorific value of methane, a ratio which lies between 0.007 and 0.010 was discovered to be an advantageous ratio of the sum of the areas of the injection openings to the effective outlet area of the premix burner.

According to one development of the invention, two parallel rows of holes with doubled hole distance between the injection openings, the holes of which are arranged in an offset manner in relation to each other, are provided per air inlet duct in each case. As a result of the different injection positions, combustion stability can be positively influenced.

According to a further development of the invention, one row of holes with injection openings is provided per air inlet duct in each case.

In addition to the new-type premix burner, a method for reworking such premix burners is a subject of the invention. It is the object of the method to rework a conventional premix burner with small injection openings with minimum cost so that a new-type premix burner with larger injection openings is obtained. For this purpose, it is proposed to close every other hole of a row of holes of injection openings and to enlarge the diameter of the remaining injection opening. For closing, the holes are welded up or soldered up, for example. A small stopper can also be used, for example.

In one development of the invention, the injection opening which lies nearest the outlet of the premix burner to the combustion chamber is closed. Starting from there, one hole is bored out and one hole closed alternately in each case.

In one development of the invention, the injection opening, which lies nearest the outlet of the premix burner to the combustion chamber, is bored out. Starting from there, one hole is closed and one hole bored out alternately in each case.

According to one development of the invention, the diameter of the remaining injection openings is enlarged so that its outlet area is doubled.

DETAILED DESCRIPTION

Figure 2:
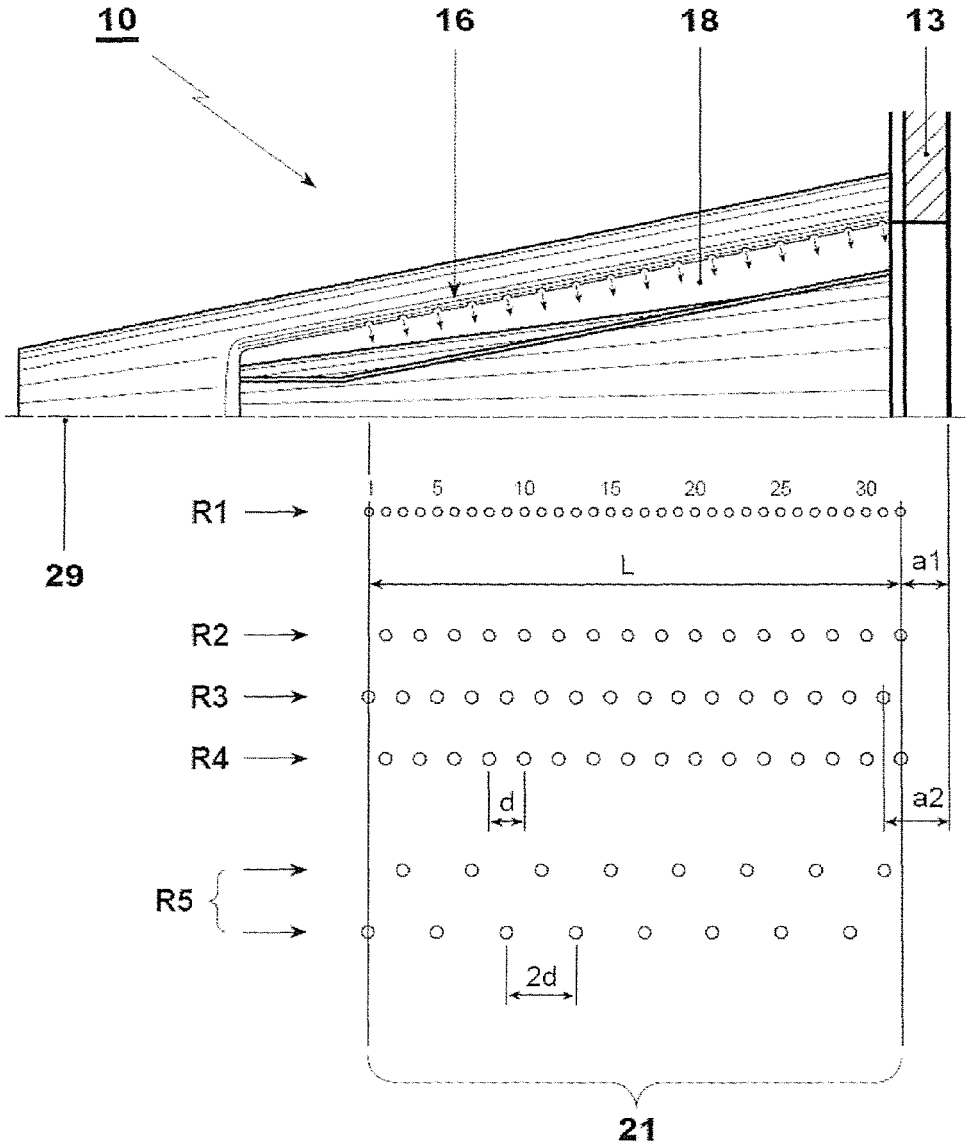
FIG. 2 shows different rows of holes of injection openings of known and new configurations in relation to the premix burner.

In FIG. 2, one half of a premix burner 10 of the double-cone type is shown, as is used in large gas turbines. Shown is the conical character of the premix burner 10, which is delimited towards the combustion chamber (to the right in FIG. 2) by means of a front plate 13. Also shown is an air inlet duct 18, on the outer side of which a fuel line 16 for the gaseous fuel is transversely arranged.

In conventional premix burners, the gaseous fuel is injected into the air inlet duct 18 through injection openings 21 which in shape and arrangement form the depicted row of holes R1. In this case, it involves 32 injection openings 21 with a diameter ratio of 0.0086 (for natural gas; 0.0097 for a gas with lower calorific value), which have a distance from each other of 8 mm and are therefore distributed over a length L of 8×31 mm. From the outer side of the front plate 13, the row of holes R1 has a distance of 15 mm.

In order to now achieve here more intense fuel jets, the row of holes R1 is replaced by the row of holes R2 or R3, in which provision is made for only 16 injection openings 21 with an increased diameter ratio of 0.011 and a distance d of 16 mm in each case. So that the sum of all the flow cross sections of the injection openings compared with the hole row R1 remains the same, the fewer individual jets, however, are more intense and therefore reach deeper into the flow of combustion air and lead to a significant improvement of intermixing. The distance of the row of holes to the front plate 13 in this case can remain unaltered compared with the row of holes R1 (row of holes R2; distance a1). It is also conceivable, however, to increase this distance from 15 mm to 23 mm (row of holes R3; distance a2), as a result of which the region of a stable combustion is shifted to lower temperatures.

The diameter ratio of 0.012 for the injection openings 21 of the rows of holes R2 and R3 is provided for the use of natural gas. If, instead of natural gas, a gaseous fuel with a calorific value of less than 80% of the calorific value of methane is injected, the injection openings 21 preferably all have a diameter ratio of 0.014.

In the embodiment R5, provision is made for two parallel rows of holes with injection openings which are offset in relation to each other so that the two rows of holes are positioned "by a stagger" in relation to each other. The distance between the holes of a row of holes in this case is doubled to 2×d.

The distribution of the mass flow of gaseous fuel to considerably fewer injection openings with larger diameter is essential for improved intermixing, combustion and pollutant emission. Contrary to the expectation according to which for a better mixing-through a large number of small injection holes with correspondingly high pressure loss during injection would lead to improved mixing-through, emissions can be reduced on account of the greater penetration depth with larger holes. It is understood that the diameters and distances apart of the injection openings 21 in a row of holes can have certain variations within the scope of the invention in order to be able to compensate for unevenness in the combustion air flow.

LIST OF DESIGNATIONS

10 Premix burner
11, 12 Partial cone shell
13 Front plate
14, 15 Cylinder
16, 17 Fuel line
18, 19 Air inlet duct
20 Combustion air
21 Injection opening
22 Fuel (gaseous)
23 Fuel (liquid)
24 Nozzle
25 Combustion chamber
26 Hole
27 Cooling air
28 Flame front
29 Axis
30 Inner space (conical)
a1, a2 Distance
d Distance
H Height of the air inlet ducts
L Length
R1, . . . ,R5 Row of holes

What is claimed is:

1. A premix burner for a gas turbine, in the form of a double-cone burner, comprising two partial cone shells arranged nested one inside the other, forming air inlet ducts between the two partial cone shells, through which outside combustion air flows into a conical inner space of the premix burner, wherein linear rows of holes of injection openings, which extend transversely to a flow direction of the combustion air, are arranged on the outer walls of the air inlet ducts and through which a gaseous fuel is injected into the combustion air which flows past transversely to the injection openings, the injection openings have a diameter ratio of a diameter of the injection opening to an effective outlet diameter of the premix burner between 0.011 and 0.015, wherein the diameter of a circle which has the same area as an outlet opening of the premix burner, which is an opening formed by the two partial cone shells at an end of the two partial cone shells opposite to the end where the gaseous fuel is injected, is defined as the effective outlet diameter of the premix burner.

2. A premix burner for a gas turbine, in the form of a double-cone burner, comprising two partial cone shells arranged nested one inside the other, forming air inlet ducts between the two partial cone shells, through which outside combustion air flows into a conical inner space of the premix burner, wherein linear rows of holes of injection openings, which extend transversely to a flow direction of the combustion air, are arranged on the outer walls of the air inlet ducts and through which a gaseous fuel is injected into the combustion air which flows past transversely to the injection openings, the injection openings have a diameter ratio of a diameter of the injection opening to an effective outlet diameter of the premix burner which is greater than 0.015 and less than 0.017, wherein the diameter of a circle which has the same area as an outlet opening of the premix burner, which is an opening formed by the two partial cone shells at an end of the two partial cone shells opposite to the end where the gaseous fuel is injected, is defined as the effective outlet diameter of the premix burner.

3. The premix burner as claimed in claim 1, wherein the injection openings have in each case a ratio of a diameter of the injection opening to a height of the air inlet duct between 0.097 and 0.153.

4. The premix burner as claimed in claim 1, wherein the injection openings have in each case a ratio of a sum of areas of the injection openings to an effective outlet area of the premix burner between 0.0051 and 0.0097.

5. The premix burner as claimed in claim 1, wherein all injection openings of a row of holes are equidistant and have the same diameter.

6. The premix burner as claimed in claim 1, wherein a distance between adjacent injection openings of a row of holes is approximately 16 mm.

7. The premix burner as claimed in claim 1, wherein the premix burner is intended for operation with natural gas as the gaseous fuel, and the injection openings have in each case a ratio of a diameter of the injection opening to a height of the air inlet ducts between 0.109 and 0.124.

8. The premix burner as claimed in claim 1, wherein the premix burner is intended for operation with a gaseous fuel which has a lower calorific value than natural gas, and the injection openings have in each case a ratio of a diameter of the injection opening to a height of the air inlet ducts between 0.123 and 0.140.

9. The premix burner as claimed in claim 1, wherein the premix burner is intended for operation with natural gas as the gaseous fuel, and the injection openings have in each case a ratio of a sum of areas of the injection openings to an effective outlet area of the premix burner between 0.005 and 0.008, or the premix burner is intended for operation with a gaseous fuel which has a lower calorific value than natural gas, and the injection openings have in each case a ratio of a sum of the areas of the injection opening to an effective outlet area of the premix burner between 0.007 and 0.010.

10. The premix burner as claimed in claim 1, wherein two parallel rows of holes with injection openings which are offset in relation to each other are provided per air inlet duct in each case.

* * * * *